United States Patent [19]

Gardiner

[11] Patent Number: 4,993,173

[45] Date of Patent: Feb. 19, 1991

[54] SHOE SOLE STRUCTURE

[76] Inventor: James T. Gardiner, 5316 Magenta Ct., Las Vegas, Nev. 89108

[21] Appl. No.: 399,863

[22] Filed: Aug. 29, 1989

[51] Int. Cl.[5] ..... A43B 07/06

[52] U.S. Cl. ..... 36/3 B; 36/3 R

[58] Field of Search ..... 36/3 R, 3 B, 29, 107, 36/30 R

[56] References Cited

U.S. PATENT DOCUMENTS

| | | | |
|---|---|---|---|
| 900,967 | 10/1908 | Miller | 36/28 |
| 2,267,125 | 12/1941 | Molnar | 36/3 R |
| 2,441,879 | 5/1948 | Gantt | 36/3 R |
| 2,552,711 | 5/1951 | Dunker | 36/3 R |
| 2,558,973 | 7/1951 | Meaker | 36/3 B |
| 2,741,038 | 4/1956 | Eliassen | 36/3 R |
| 3,050,875 | 8/1962 | Robbins | 36/3 R |
| 3,973,336 | 8/1973 | Ahn | 36/3 B |
| 4,102,061 | 7/1973 | Saaristo | 36/28 |
| 4,499,672 | 2/1985 | Kim | 36/3 B |
| 4,561,195 | 12/1985 | Onoda et al. | 36/30 R |
| 4,602,441 | 7/1986 | El Sakkaf | 36/3 B |
| 4,654,982 | 4/1987 | Lee | 36/3 B |
| 4,860,463 | 8/1989 | Pin | 36/3 B |

FOREIGN PATENT DOCUMENTS

| | | | |
|---|---|---|---|
| 0319968 | 6/1989 | European Pat. Off. | 36/3 R |
| 1109597 | 11/1956 | France | 36/3 B |
| 1315297 | 12/1962 | France | 36/3 R |
| 1562765 | 3/1969 | France | 36/3 B |
| 2521407 | 8/1983 | France | 36/3 B |

*Primary Examiner*—Steven N. Meyers

*Attorney, Agent, or Firm*—Quirk, Tratos & Roethel

[57] ABSTRACT

A shoe sole made of a flexible, resilient material and having a central longitudinal passageway therein. A fresh air intake is located at the heel region of the sole and provides ventilation air to the passageway. With each stride, the wearer pumps air from the heel through the longitudinal passageway and then out upwardly extending vents to the interior of the shoe.

18 Claims, 2 Drawing Sheets

SHOE SOLE STRUCTURE

BACKGROUND OF THE INVENTION

This invention relates to a shoe sole structure, and more particularly to a ventilated shoe sole structure.

There has long been a need to design shoes to minimize, if not eliminate, the unpleasant odor that is generated during wear. Additionally, there is a need to design a shoe that will keep the wearer's foot cooler and drier. The normal shoe construction traps the air around the wearer's foot and permits the natural perspiration and body odor generated during the day to simply collect within the shoe. The shoe material becomes impregnated with this perspiration and odor and eventually both the wearer and those around him are subjected to this unpleasant occurrence.

There have been previous attempts to remedy this situation. For example, U.S. Pat. No. 2,552,711 (Dunker) discloses a boot that is provided with a spring-type pump arrangement that attempts to circulate exterior air into the toe region of the shoe. An air check valve is utilized to permit exterior air to be drawn into the region of the heel so that when the wearer takes a step, a leather plate is depressed which forces air into the toe region of the boot. A mechanical spring is placed in the heel of the boot to return the leather plate to its upper position.

This arrangement, however, requires the use of the check valve to ensure that the air is forced into the toe region of the shoe. Without the check valve, the exterior air would have tendency to fllow bback out the rear of the boot and not serve its intended purpose. The check valve is also located inside the heel of the boot and its ability to function may be impaired by the heel of the wearer pressing down on the leather plate. The inside configuration and dimensions of the shoe also change during each step. The heel of the wearer's foot actually moves up and down through the travel space through which the leather plate traverses to push the air toward the toe region. Thus maintaining a comfortable fit about the wearer's heel is not possible with this design. There likewise is no support for the middle region or the toe region of the foot since both of these areas change size up and down during each step by the wearer. The use of a spring under the wearer's heel also creates an uncomfortable foreign object inside the shoe which will cause discomfort to the wearer during each step. Eventually, the spring would actually wear through the leather plate and contact directly the underside of the wearer's heel causing direct discomfort not unlike walking on a rock. Finally this design is quite difficult to manufacture and assemble in that many parts not normally found in a shoe or boot must be added. Also, the failure of any of these moving parts will completely destroy the functionality of this shoe.

Another attempted remedy is shown in U.S. Pat. No. 3,050,875 (Robbins). This patent discloses a shoe sole comprised of a plurality of layers. The intermediate layer has a series of oval cavities interconnected by small passageways. The toe region of the sole has a plurality of small vents. When the wearer takes a step, the air inside the shoe is circulated from the heel of the shoe to the toe of the shoe and then upwardly through the vents. When the wearer's foot reaches then end of his step, the air recirculates backwardly from the toe of the shoe to the heel of the shoe.

The only external access &:o the intermediate sole cavities is through the small vents in the toe of the shoe. The only possible fresh, outside air that can be used for circulation comes in through the space between the wearer's ankle and the upper opening of the shoe. This outside air must actually pass over the wearer's foot on its way to the intermediate sole cavities. This air will already have been subjected to the odors present on the wearer's foot. This design actually requires a plurality of interconnected chambers to effect the circulation of the air. Much of the air that is flowing back and forth is the same air that has remains within the shoe and has already been subjected to the odors present on and around the foot of the wearer. The numerous cavities also results in large, irregular areas under the foot of the wearer which fails to provide adequate support to the wearer's foot and will cause discomfort during use.

Yet another proposed remedy is shown in U.S. Pat. No. 4,102,061 (Saaristo). Two small vents located in the center of the sole are disclosed as providing passageways for air to be vented to the interior of the shoe. The air intake, however, is located very close to the surface walked upon which increases the possibility that dirt or water may be sucked into the sole area thus contaminating the outside air and diminishing its ventilating effect. This design also utilizes a check valve to ensure flow is only in one direction which increases the possibility of premature failure of the design in the event of failure of the check valve. As with the other designs previously discussed, the interior surface of the shoe which is contacted by the bottom of the foot actually deforms to decrease the size of the chambers to effect the flow of air, but this deformation results in actual or potential discomfort to the wearer.

It is an object of the present invention to provide a shoe sole structure that effectively and efficiently ventilates the interior areas of a wearer's foot.

It is a feature of the present invention to utilize a single continuous transforming passageway to pump or feed fresh outside air from the heel region of the shoe forward to the toe region of the shoe. This is accomplished during each stride of the wearer and without the necessity of check valves or springs to effect the circulation of the air. Air that has been contaminated by the foot of the wearer is prevented from returning to the passageway by the flexible and unique design of the sole.

It is an advantage of the invention that fresh, uncontaminated air is pumped or fed to the interior of the shoe in order to cool and ventilate the foot of the wearer automatically with each step made by the wearer.

BRIEF SUMMARY OF THE INVENTION

A shoe is provided with a flexible sole that has at least one longitudinal passageway extending from the heel region to the toe region. An upwardly directed external intake vent is associated with the flexible sole to provide uncontaminated, fresh air to the longitudinal passageway. Because of the flexibility of the shoe sole, the rolling action on the sole that occurs during each step taken by the wearer causes this fresh air to be pumped or fed through the longitudinal passageway to the toe of the sole where it is directed through vertical outlet vents into the interior of the shoe. During the rolling action of each step, the longitudinal passageway is momentarily compressed from the rear of the sole toward the front which effects the pumping of the air. Adequate support for the entire bottom of the wearer's foot is maintained at all times because the interior sole of the shoe that comes into contact with the wearer's foot remains undeformed during the entire step.

DETAILED DESCRIPTION OF THE PREFERRED EMBODIMENTS

Figure 1:
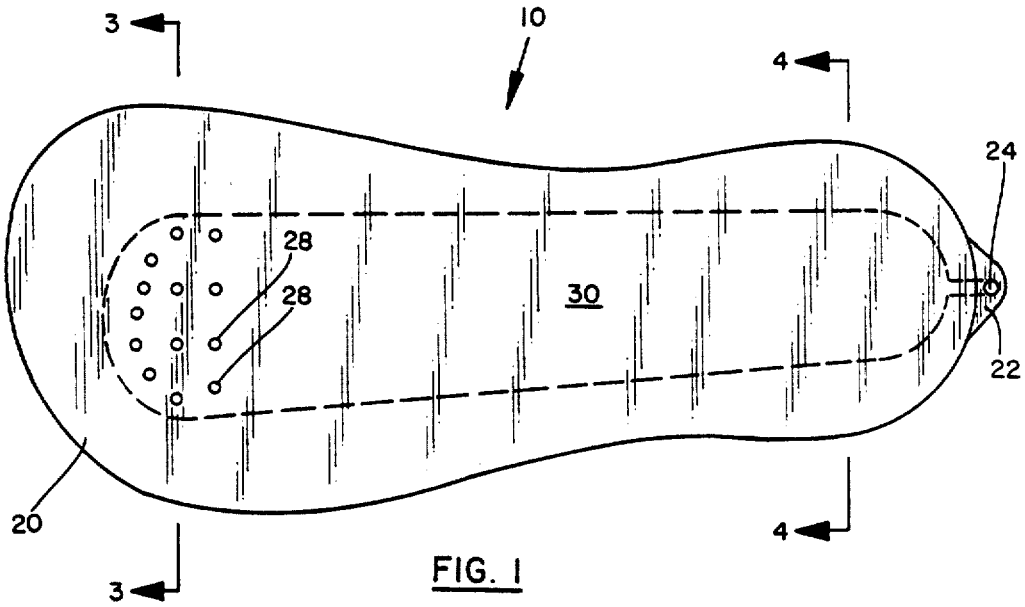
FIG. 1 is a plan view of the shoe sole of the present invention.
Figure 2:
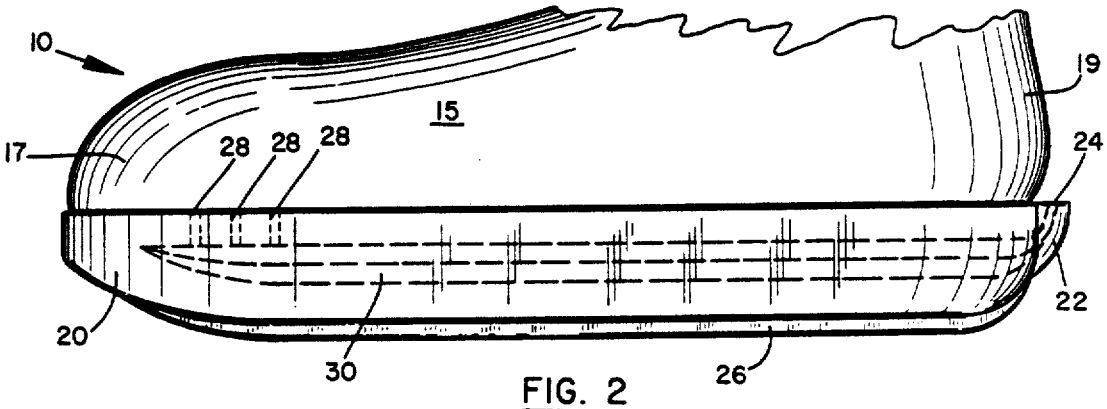
FIG. 2 is an elevation view of the shoe sole of the present invention showing in phantom the longitudinal and vertical interior vent passageways.

FIGS. 1 and 2 show generally at 10 the shoe of the present invention. The shoe comprises an upper body 15 designed to accommodate the foot of the wearer. Attached to the upper body 15 in a conventional manner is a sole 20. The sole 20 is made out of flexible material, such as rubber, plastic or other natural or synthetic elastomeric materials. In the preferred embodiment, the sole 20 is made by injection molding which allows the internal passageways, to be hereinafter described, to be provided accurately and easily in the sole 20.

On the bottom of the sole 20, there is provided an integrally molded longitudinal ridge 26. The ridge 26 extends along the length of the sole 20 at least as far as the interior length of the passageway 30. The width of the ridge 26 is slightly narrower than the width of the longitudinal passageway 30. The ridge also extends a short distance below the bottom surface of the sole 20 as will be more fully explained herein.

The sole 20 also includes a central longitudinal passageway 30 extending from the heel region 19 of the sole continuously to the toe region 17. At the toe region, a plurality of vertical outlet vent passageways 28 extend upwardly through the sole 20 opening into the interior of the upper body 15 at the toe 17. At the heel end of the sole 20, an integrally molded extension piece 22 extends beyond the end of the heel 19 of the upper body 15. The extension piece has an intake passageway 24 that communicates directly with the internal longitudinal passageway 30. The intake passageway 24 turns upwardly and communicates with the outside air on the upper surface of the extension piece 22.

In the preferred embodiment, the outlet vent passageways 28 have a generally circular cross-section. Likewise, the air intake passageway 24 also has a generally circular cross-section.

Figure 3:
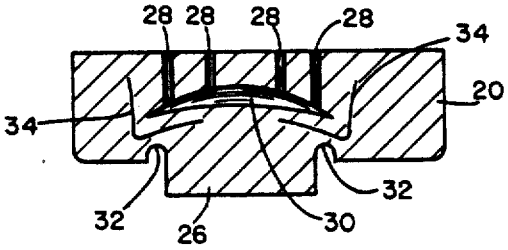
FIG. 3 is a cross-sectional view taken along line 3—3 of FIG. 1 showing the shoe sole in an unloaded condition.
Figure 4:
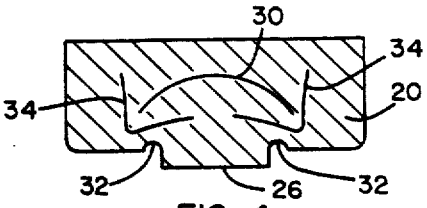
FIG. 4 is a cross-sectional view taken along line 4—4 of FIG. 1 showing the shoe sole in a loaded condition.

The central longitudinal passageway has a generally crescent-shaped cross-section and as shown in FIG. 3. When pressure is not applied to the ridge 26, the longitudinal passageway 30 remains open which allows air to pass into and remain in the passageway 30. As shown in FIG. 4, if pressure is applied to the ridge 26 (as would occur during the act of walking on the sole), the flexibility of the material of the sole allows the ridge 26 to be forced upwardly into the space of the longitudinal passageway 30 thereby closing the longitudinal passageway at the point at which the pressure is applied and preventing air from passing through the passageway 30 in either direction at that point. This sealing effect is enhanced by the use of an indented channel 32 that extends along the side of the ridge 26 for the full length of the ridge. The use of these channels 32 allows the ridge to flex upwardly to close the passageway 30 during the wearer's step. Additionally reinforcing strips 34 are provided along the length of the sole on each side of the passageway 30 to provide lateral support to the sole. The reinforcing strips also allow for greater flexibility in the ridge area and also increase the wear and longevity of the sole. These reinforcing strips may be made out of a high tensile membrane or woven material, such as Kevlar or the like.

Figure 5:
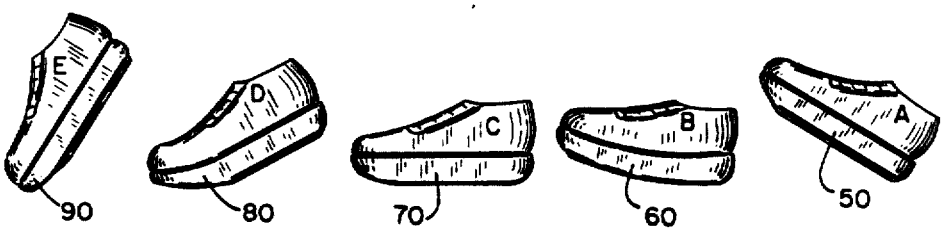
FIG. 5 is a seriatim view showing the contact points with the ground that the shoe sole of the present invention undergoes during a single step by the wearer.
Figure 6:
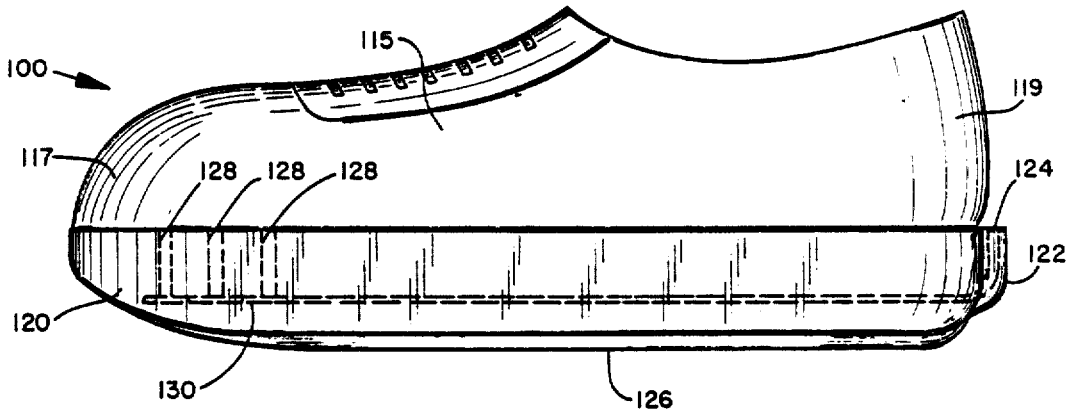
FIG. 6 is an elevation view of the shoe sole of an alternate embodiment of the present invention showing in phantom the longitudinal and vertical interior vent passageways.
Figure 7:
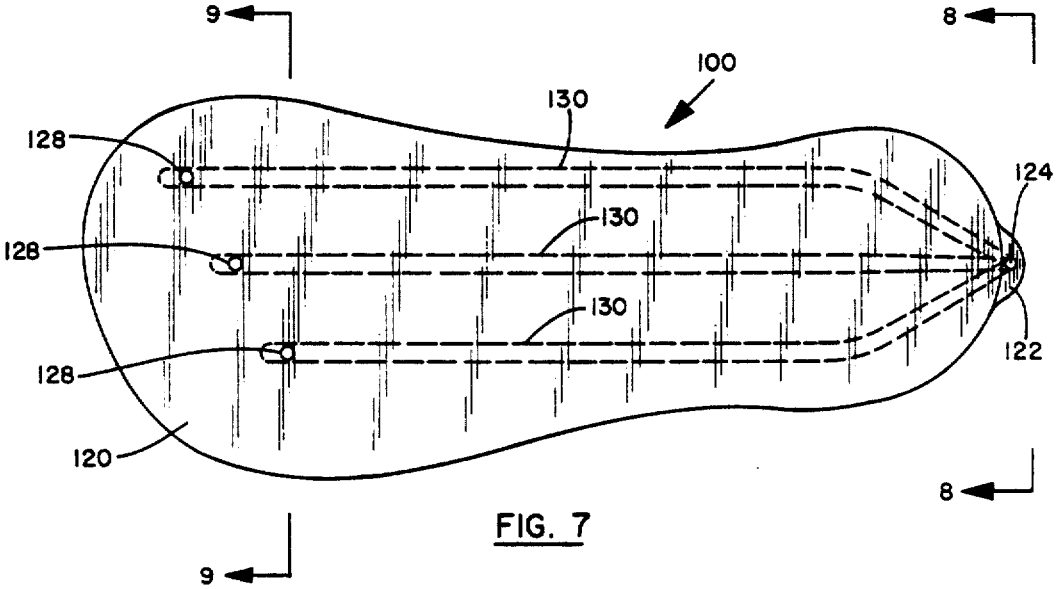
FIG. 7 is a plan view of the shoe sole of an alternate embodiment of the present invention.
Figure 8:
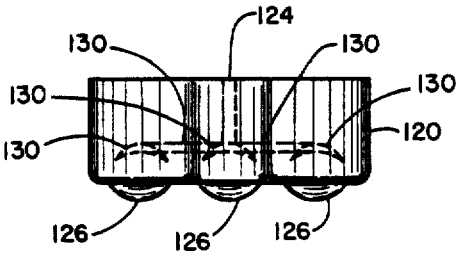
FIG. 8 is a cross-sectional view taken along line 8—8 of FIG. 7 showing the shoe sole of the alternate embodiment of the present invention in an unloaded condition.
Figure 9:
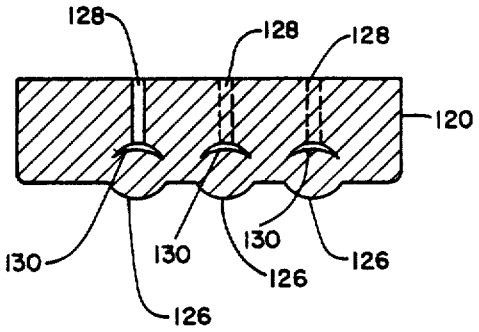
FIG. 9 is a cross-sectional view taken along line 9—9 of FIG. 7 showing the shoe sole of an alternate embodiment of the present invention in an unloaded condition.

When the foot is entirely off of the ground, the entire length of the longitudinal passageway 30 is open and filled with air. During the actual walking movement, the foot of the wearer goes through a rolling motion from the heel region 19 to the toe region 17 as shown in FIG. 5. At "A" in FIG. 5, the heel of the shoe comes in contact with the ground as shown at location 50. The ridge 26 is forced into the passageway 30 at location 50 which seals the end of the passageway 30. The crescent-shaped cross-section of the passageway 30 allows the flexible material of the sole to actually close off the passageway at the point of contact and prevents air in the passageway 30 from flowing rearwardly out of the passageway 30. Rather the air in the passageway 30 is fed or pumped forwardly to the front of the sole where it is eventually forced upwardly out of the outlet vents 28 and into the interior of the upper 15.

As the step proceeds to "B," the ridge 26 had been forced into the passageway 30 from the location 50 all the way to location 60, causing the passageway 30 to be completely closed between these two locations. This decreases the volume of the passageway 30 from the volume that the passageway 30 had in the open condition which causes even more air to be fed or pumped through outlet vents 28 into the interior of the upper 15. As the step proceeds to "C," the passageway reaches its maximum closure in that ridge 26 has been forced into the passageway 30 from location 50 all the way to location 70.

When the step reaches "D," the heel of the sole comes off the ground. The flexibility and resiliency of the sole material causes the ridge 26 to spring back from inside the passageway 30 allowing the passageway 30 to reopen. Air from air intake 24 flows into passageway 30 providing a fresh supply of air for the next step. However, at location 80, the passageway 30 is still closed due to the effect of the ridge 26 pushing into passageway 30 at this specific location. This closure prevents contaminated air from around the foot of the wearer from back flowing into the longitudinal passageway 30.

Finally, when the step reaches "E," the only point of contact of the sole to the ground is at location 90. The entire passageway 30 is again open and filled with fresh air from air intake 24. The fresh air in the passageway 30 acts as a effective barrier to contaminated air passing backward through outlet vents 28 into the sole 20 of the shoe.

The orientation of the air intake 24 at the upper surface of the extension 22, minimizes the possibility that water, dirt or other contaminants from the ground will be drawn into the longitudinal passageway 30. The air intake 24 may also be extended higher up the outside of the upper 15 if so desired.

An alternate embodiment of the present invention is shown in FIGS. 6–9. In this embodiment, three central passageways 130 are provided to feed air to the toe end 117 of the shoe 100. Preferably, each passageway 130 runs parallel to the other passageways 130 and each passageway 130 terminates at the toe end 117 of the shoe 100 in an upwardly extending outlet vent 128. The particular location of each outlet vent 128 may be varied in the toe end 117 of the shoe 100 to distribute the fresh air over a wide area of the wearer's foot.

The operation of the alternate embodiment of the present invention is quite similar to the operation described with reference to the shoe sole shown in FIGS. 1–5. When the foot is off the ground, each of the central passageWays 130 fill up with fresh air through air intake passage 124. As the heel of the shoe first hits the ground during the wearer's step, the longitudinal ridges 126 forces the flexible material of the sole 120 into each of the longitudinal passageways 130 which causes the fresh air in those ,passageways 130 to be pumped or fed to the vertical outlet vents 128 and thus to the wearer's foot to ventilate the foot.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim:

1. An article of manufacture comprising:

a flexible sole having at least one longitudinal passageway therein, (b) a vertical outlet vent extending upwardly from the longitudinal passageway, (c) an extension member joined to the sole, said extension member having an upwardly extending intake passageway for drawing outside air into the longitudinal passageway to be pumped to the vertical outlet vent, and (d) a longitudinal ridge attached to the bottom of the sole and extending generally the length of thee longitudinal passageway for affecting the momentary closure of the longitudinal passageway at progressive locations along the length of the longitudinal passageway during a step whereby air is pumped along the longitudinal passageway from the intake passageway to the outlet vent.

2. The article of manufacture of claim 1 wherein the flexible sole is made from rubber.

3. The article of manufacture of claim 1 wherein the flexible sole is made from elastomeric material.

4. The article of manufacture of claim 1 wherein the longitudinal passageway is formed centrally in the sole.

5. The article of manufacture of claim 1 wherein the longitudinal passageway has a generally crescent-shaped cross-section and the longitudinal ridge has a cooperating curved upper surface that momentarily closes the longitudinal passageway during a step.

6. The article of manufacture of claim 1 wherein a reinforcing member is disposed along the length of the longitudinal passageway between the longitudinal passageway and the longitudinal ridge.

7. The article of manufacture of claim 1 wherein the longitudinal ridge is integrally formed with the sole.

8. The article of manufacture of claim 1 wherein the number of longitudinal passageways is three.

9. An article of manufacture comprising:

(a) a flexible sole having at least one longitudinal passageway therein.

(b)) a vertical outlet vent extending upwardly from the longitudinal passageway, (c) an extension member joined to the sole, said extension member having an upwardly extending intake passageway for drawing outside air into the longitudinal passageway to be pumped to thee vertical outlet vent, and (d) a longitudinal ridge attached to the bottom of the sole for pumping the air along the longitudinal passageway and (e) an indented channel disposed on each side of the longitudinal ridge.

10. A ventilated shoe comprising:

(a) an upper body designed to accommodate the foot of a wearer, (b) a flexible sole joined to the upper body, said flexible sole having at least one longitudinal passageway therein, (c) a vertical passageway vent extending upwardly from the longitudinal passageway, (d) an extension member joined to the sole, said extension member having an upwardly extending intake passageway for drawing outside air into the longitudinal passageway to be pumped to the vertical vent passageway, and (e) a longitudinal ridge attached to the bottom of the sole and extending generally the length of the longitudinal passageway for effecting the momentary closure of the longitudinal passageway at progressive locations along the length of the longitudinal passageway during a step whereby air is pumped along the longitudinal passageway from the intake passageway to the outlet vent.

11. The ventilated shoe of claim 10 wherein the flexible sole is made from rubber.

12. The ventilated shoe of claim 10 wherein the flexible sole is made from elastomeric material.

13. The ventilated sole of claim 10 wherein the longitudinal passageway is formed centrally in the sole.

14. The ventilated shoe of claim 10 wherein the longitudinal passageway has a generally crescent-shaped cross-section and the longitudinal ridge has a cooperating curved upper surface that momentarily closes the longitudinal passageway during a step.

15. The ventilated shoe of claim 10 wherein a reinforcing member is disposed along the length of the longitudinal passageway between the longitudinal passageway and the longitudinal ridge.

16. The ventilated shoe of claim 10 wherein the longitudinal ridge is integrally formed with the sole.

17. The article of manufacture of claim 10 wherein the number of longitudinal passageways is three.

18. A ventilated shoe comprising:

(a) an upper body designed to accommodate the foot of a wearer, (b) a flexible sole joined to the upper body, said flexible sole having at least one longitudinal passageway therein, (c) a vertical outlet vent extending upwardly from the longitudinal passageway, (d) an extension member joined to the sole, said extension member having an upwardly extending intake passageway for drawing outside air into the longitudinal passageway to be pumped to the vertical outlet vent, and (e) a longitudinal ridge attached to the bottom of the sole for pumping the air along the longitudinal passageway, and (f) an indented channel disposed on each side of the longitudinal ridge.

* * * * *